US005828292A

United States Patent [19]

Kokhan

[11] Patent Number: 5,828,292

[45] Date of Patent: Oct. 27, 1998

[54] BUTTON EMERGENCY SIGNAL VIA INCORPORATED TRANSMITTER

[76] Inventor: Viatcheslav A. Kokhan, Flat 1, 89 Longfleet Road, Poole, Dorset BH15 2HP, United Kingdom

[21] Appl. No.: 639,477

[22] Filed: Apr. 29, 1996

[51] Int. Cl.[6] ..... G08B 25/00

[52] U.S. Cl. ..... 340/307; 340/692; 379/45; 379/66

[58] Field of Search ..... 340/307, 287, 340/506, 692; 379/66, 45, 38; 455/89; 342/419

[56] References Cited

U.S. PATENT DOCUMENTS

| | | | |
|---|---|---|---|
| 3,794,852 | 2/1974 | Willis | 340/307 |
| 3,873,844 | 3/1975 | Willis | 340/307 |
| 4,017,844 | 4/1977 | Facchini et al. | 340/307 |
| 4,630,035 | 12/1986 | Stahl et al. | 340/307 |
| 4,928,099 | 5/1990 | Drake | 340/307 |
| 5,254,970 | 10/1993 | Brady | 340/692 |
| 5,305,370 | 4/1994 | Kearns et al. | 379/66 |
| 5,475,751 | 12/1995 | McMonagle, Jr. et al. | 379/45 |

*Primary Examiner*—Jeffery Hofsass
*Assistant Examiner*—John Tweel, Jr.

[57] ABSTRACT

A 3-button emergency signal via incorporated transmitter device including a housing with 3 push button switches situated thereon. Also included is a transmitter and a reset module positioned within the housing and in communication with the switches. The transmitter is adapted to transmit a unique transmission signal via free space for receipt by a specific emergency facility upon the depression of a designated button. The present invention thus allows the receiving emergency facility to locate the user and reactivate the device for the further use by transmitting a unique signal via the reset module incorporated in this device.

3 Claims, 5 Drawing Sheets

BUTTON EMERGENCY SIGNAL VIA INCORPORATED TRANSMITTER

BACKGROUND OF THE INVENTION

1. Field of the Invention

The present invention relates to a 3-button emergency signal via incorporated transmitter device and more particularly pertains to informing an emergency facility of the location of a user when conventional methods of communication are unavailable.

2. Description of the Prior Art

The use of emergency signalling devices is known in the prior art. More specifically, emergency signalling devices heretofore devised and utilized for the purpose of obtaining emergency assistance are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,305,370 to Kearns et al.; U.S. Pat. No. 5,091,930 to Shapiro; U.S. Pat. Des. 304,310 to Calis; U.S. Pat. No. 5,227,776 to Starefoss; U.S. Pat. No. 5,264,828 to Meiksin et al.; and U.S. Pat. No. 4,045,799 to Dapiran are provided as being of general interest.

In this respect, the 3-button emergency signal via incorporated transmitter device according to the present invention substantially departs from the conventional concepts and designs of the prior art, and in so doing provides an apparatus primarily developed for the purpose of informing an emergency facility of the location of a user when conventional methods of communication are unavailable.

Therefore, it can be appreciated that there exists a continuing need for a new and improved 3-button emergency signal via incorporated transmitter device which can be used for informing an emergency facility of the location of a user when conventional methods of communication are unavailable. In this regard, the present invention substantially fulfills this need.

SUMMARY OF THE INVENTION

In view of the foregoing disadvantages inherent in the known types of emergency signalling devices now present in the prior art, the present invention provides an improved 3-button emergency signal via incorporated transmitter device. As such, the general purpose of the present invention, which will be described subsequently in greater detail, is to provide a new and improved 3-button emergency signal via incorporated transmitter device which has all the advantages of the prior art and none of the disadvantages.

To attain this, the present invention essentially comprises a portable housing with a generally rectangular configuration. The housing has a front face, a rear face, a top surface, a bottom surface, and a pair of side surfaces formed therebetween defining an interior space. The housing further includes a recess centrally formed in the front face thereof. The recess has a periphery including a pair of opposite open side edges in communication with the side surfaces of the housing. A transparent lid is also included with a planar top surface and a pair of lips formed normally with respect to the top surface. One of the lips is pivotally coupled to one of the side edges of the recess via a hinge thus allowing the lid to be selectively situated about recess in a closed orientation. Such also allows the lid to reside in an open orientation for affording access to the recess. A locking mechanism is situated on a side surface of the housing opposite the hinge. The locking mechanism is adapted to allow the selective securement of the lid in the closed orientation thereof. For allowing the securement of the housing to an article of clothing, a clip is included comprising a thin rectangular member pivotally coupled to the rear face of the housing. Also included is a plurality of push button switches linearly aligned within the recess. The switches include a first switch adapted to transmit a first activation signal upon the depression thereof, a second switch adapted to transmit a second activation signal upon the depression thereof, and a third switch adapted to transmit a third activation signal upon the depression thereof. Each push button switch is constructed of a uniquely colored material and has a distinctive shape. A red warning light is adapted to illuminate for a predetermined amount of time upon the depression of a push button switch. Finally, a transmitter is situated within the interior space of the housing. The transmitter is electrically connected between the switches, an antenna which is also situated within the interior space of the housing, and a power source comprising a battery. The transmitter is adapted to transmit via free space a first transmission signal for intended receipt by a medical facility upon the receipt of the first activation signal, a second transmission signal for intended receipt by a law enforcement facility upon the receipt of the second activation signal, and a third transmission signal for intended receipt by a fire rescue facility upon the receipt of the third activation signal. The transmitter is further adapted to only cease transmission of a transmission signal upon the receipt of a deactivation signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved 3-button emergency signal via incorporated transmitter device which has all the advantages of the prior art emergency signalling devices and none of the disadvantages.

It is another object of the present invention to provide a new and improved 3-button emergency signal via incorporated transmitter device which may be easily and efficiently manufactured and marketed.

It is a further object of the present invention to provide a new and improved 3-button emergency signal via incorporated transmitter device which is of a durable and reliable construction.

An even further object of the present invention is to provide a new and improved 3-button emergency signal via incorporated transmitter device which is susceptible of a low cost of manufacture with regard to both materials and labor, and which accordingly is then susceptible of low prices of sale to the consuming public, thereby making such 3-button emergency signal via incorporated transmitter device economically available to the buying public.

Still yet another object of the present invention is to provide a new and improved 3-button emergency signal via incorporated transmitter device which provides in the apparatuses and methods of the prior art some of the advantages thereof, while simultaneously overcoming some of the disadvantages normally associated therewith.

Still another object of the present invention is to inform an emergency facility of the location of a user when conventional methods of communication are unavailable.

Lastly, it is an object of the present invention to provide a new and improved 3-button emergency signal via incorporated transmitter device including a housing with 3 push button switches situated thereon. Also included is a transmitter and a reset module positioned within the housing and in communication with the switches. The transmitter is adapted to transmit a unique transmission signal via free space for receipt by a specific emergency facility upon the depression of a designated button. The present invention thus allows the receiving emergency facility to locate the user and reactivate the device for the further use by transmitting a unique signal via the reset module incorporated in this device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
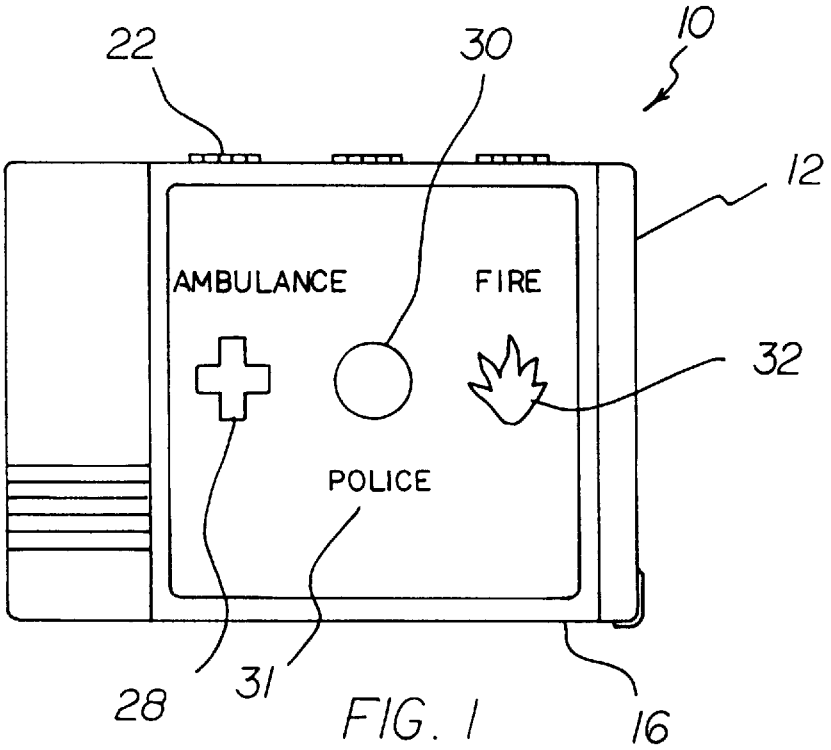
FIG. 1 is a plan view of the preferred embodiment of the 3-button emergency signal via incorporated transmitter device constructed in accordance with the principles of the present invention.
Figure 2:
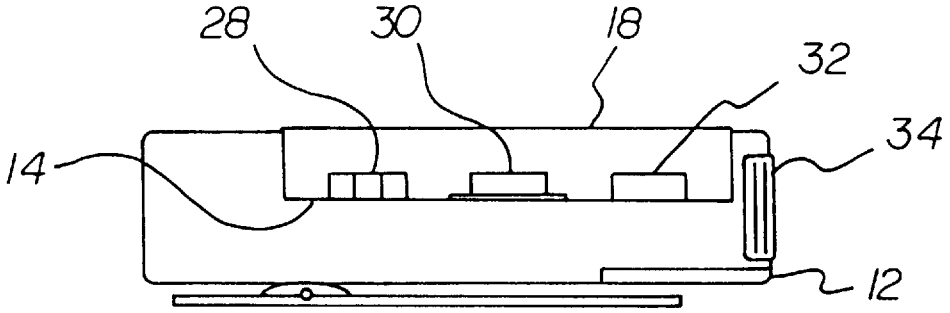
FIG. 2 is a left view thereof.
Figure 3:
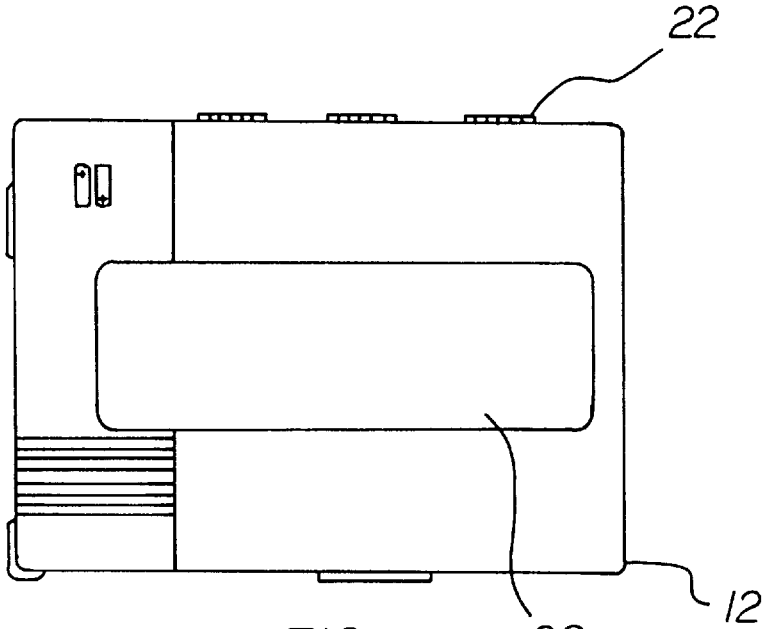
FIG. 3 is a rear plan view of thereof.
Figure 4:
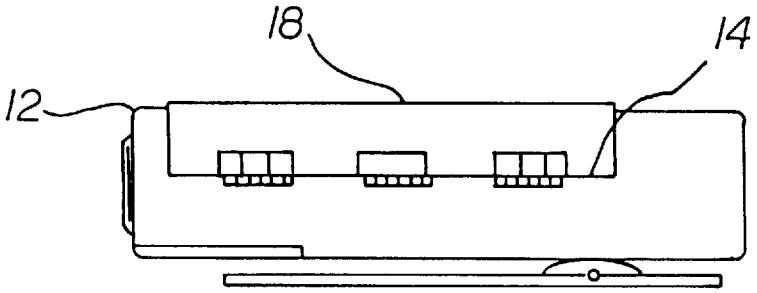
FIG. 4 is a right view thereof.
Figure 5:
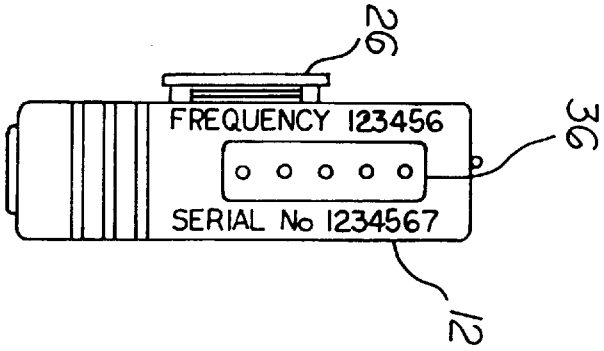
FIG. 5 is a top elevation view thereof.
Figure 6:
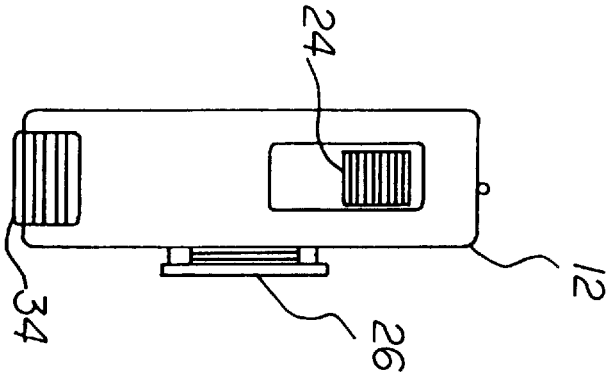
FIG. 6 is a bottom plan view of thereof.
Figure 7:
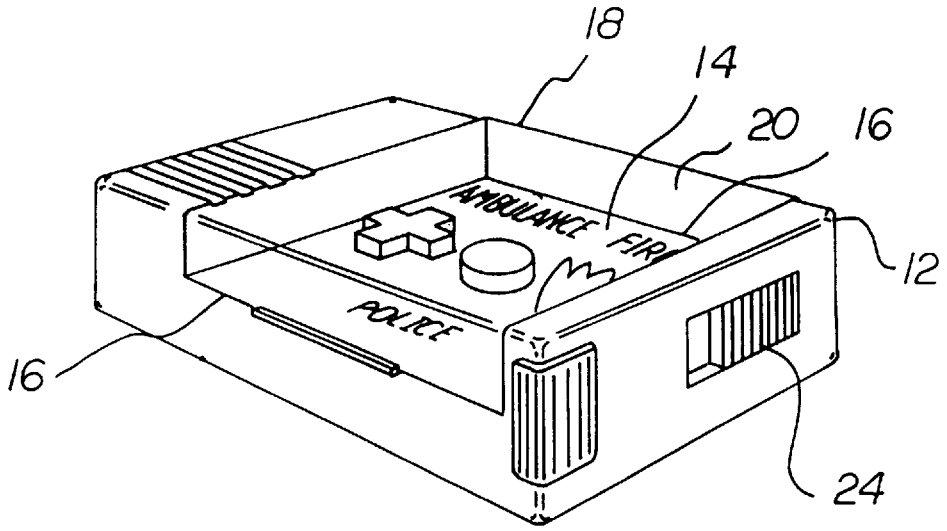
FIG. 7 is an isometric view thereof from a front perspective.
Figure 8:
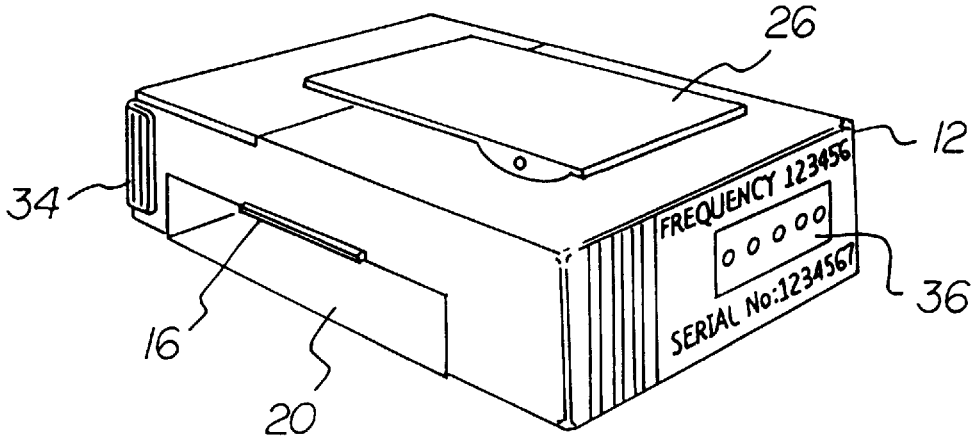
FIG. 8 is an isometric view thereof from a bottom perspective.
Figure 9:
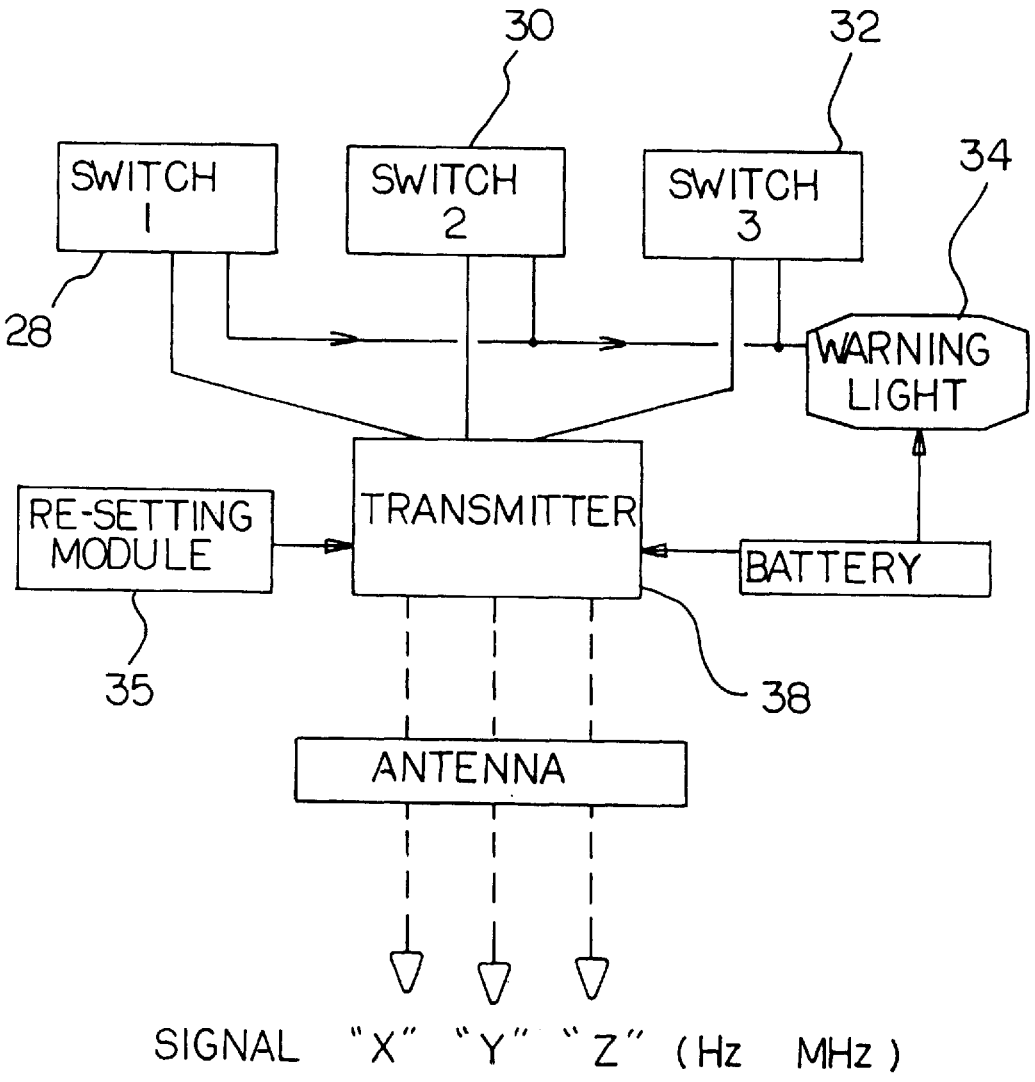
FIG. 9 is a schematic depicting the interconnection of electrical components of the present invention.

With reference now to the drawings, and in particular to FIG. 1 thereof, a new and improved 3-button emergency signal via incorporated transmitter device embodying the principles and concepts of the present invention and generally designated by the reference numeral 10 will be described.

The present invention, the new and improved 3-button emergency signal via incorporated transmitter device, is comprised of a plurality of components. Such components in their broadest context include a housing, a plurality of switches, a transmitter, and a reset module. Such components are individually configured and correlated with respect to each other so as to attain the desired objective.

More specifically, it will be noted that the system 10 of the present invention includes a portable housing 12 with a generally rectangular configuration. The housing has a front face, a rear face, a top surface, a bottom surface, and a pair of side surfaces formed therebetween defining an interior space. The housing has a height of approximately 3 centimeters, a length of approximately 10 centimeters, and a width of approximately 5 centimeters. Ideally, plastic is employed in the construction of the housing so as to afford a light weight, weatherproof, and crushproof body. The housing further includes a recess 14 centrally formed in the front face thereof. The recess has a periphery including a pair of opposite open side edges 16 in communication with the side surfaces of the housing. A transparent lid 18 is also included with a planar top surface and a pair of lips 20 formed normal with respect to the top surface. One of the lips is pivotally coupled to one of the side edges of the recess via a hinge 22 thus allowing the lid to be selectively situated about recess in a closed orientation. Such also allows the lid to reside in an open orientation for affording access to the recess. For facilitating the opening of the lid, an unnumbered flange is formed thereon. A locking mechanism 24 is situated on a side surface of the housing opposite the hinge. The locking mechanism is adapted to allow the selective securement of the lid in the closed orientation thereof. Preferably, the locking mechanism includes a slidable button which resides flush with the bottom surface of the housing. For allowing the securement of the housing to an article of clothing such as a belt, a clip 26 is included comprising a thin rectangular member pivotally coupled to the rear face of the housing.

Also included is a plurality of push button switches linearly aligned within the recess. The switches include a first cross-shaped switch 28 adapted to transmit a first activation signal upon the depression thereof, a second circular switch 30 adapted to transmit a second activation signal upon the depression thereof, and a third fire-shaped switch 32 adapted to transmit a third activation signal upon the depression thereof. It should be noted that the height of the buttons is less than the depth of the recess. Indicia 31 is printed adjacent to each button for identifying the corresponding emergency facility. Each push button switch is constructed of a uniquely colored material. A red warning light 34 is adapted to illuminate for a predetermined amount of time upon the depression of a switch. The warning light also illuminates intermittently if the power source is nearly depleted. Ideally, such amount of time is approximately 30 seconds. With the inclusion of the lid, locking mechanism, and the placement of the switches in the recess, inadvertent depression of the switches is precluded.

Finally, a transmitter 38 is situated within the interior space of the housing. The transmitter is electrically connected to the switches, an antenna which is also situated within the interior space of the housing, and a power source comprising a long-life battery. The transmitter is adapted to transmit via free space a first transmission signal for intended receipt by a medical facility upon the receipt of the first activation signal, a second transmission signal for intended receipt by a law enforcement facility upon the receipt of the second activation signal, and a third transmission signal for intended receipt by a fire rescue facility upon the receipt of the third activation signal. Preferably, such signal is of an intermittent character. The transmitter is further adapted to only cease transmission of a transmission signal upon the receipt of a deactivation signal. All the transmission signals utilized by the transmitter are electromagnetic waves distinguishable by means of varying the frequency thereof. The frequency of the electromagnetic wave is also unique to each transmitter and thus allows identification of the user.

The present invention thus allows an emergency facility who receives the transmission signal to locate the user and further deactivate the transmitter via the transmission of a deactivation signal. Such may be accomplished by means of a simple transmitter which transmits a predetermined code at predetermined frequency. Preferably, however, a module 35 which requires physical contact with the transmitter is employed to effect the deactivation thereof. To accommodate such module, a port 36 is formed on the housing for allowing the receipt of the module during deactivation. It should be noted that both methods of deactivation are further adapted to allow the device to be reused.

In an alternate embodiment, the transmitter may be equipped with means of receiving a verification signal from the emergency facility and further flashing the warning light in a unique sequence thereafter. As such, the user is notified that the emergency facility is currently triangulating the location of the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A new and improved 3-button emergency signal via incorporated transmitter device comprising, in combination:

a portable housing with a generally rectangular configuration having a front face, a rear face, a top surface, a bottom surface, and a pair of side surfaces formed therebetween defining an interior space, the housing having a recess centrally formed in the front face thereof with the recess having a periphery including a pair of opposite open side edges in communication with the side surfaces of the housing, a transparent lid having a planar top surface and a pair of lips formed normally with respect to the top surface wherein one of the lips is pivotally coupled to one of the side edges of the recess via a hinge thus allowing the lid to be selectively situated about recess in a closed orientation and further reside in an open orientation for affording access to the recess, a locking mechanism situated on a side surface of the housing opposite the hinge and adapted to allow the selective securement of the lid in the closed orientation thereof, and a clip comprising a thin rectangular member pivotally coupled to the rear face of the housing for allowing the securement thereof to an article of clothing;

a plurality of push button switches linearly aligned within the recess and comprising a first switch adapted to transmit a first activation signal upon the depression thereof, a second switch adapted to transmit a second activation signal upon the depression thereof, and a third switch adapted to transmit a third activation signal upon the depression thereof, wherein each push button switch is constructed from a uniquely colored material and the present device further comprises an associated red warning light adapted to illuminate for a predetermined amount of time upon the depression of a switch;

a transmitter situated within the interior space of the housing and electrically connected to the switches, an antenna also situated within the interior space of the housing, and a power source comprising a battery, the transmitter adapted to transmit via free space a first transmission signal for intended receipt by a medical facility upon the receipt of the first activation signal, a second transmission signal for intended receipt by a law enforcement facility upon the receipt of the second activation signal, and a third transmission signal for intended receipt by a fire rescue facility upon the receipt of the third activation signal, the transmitter further adapted to only cease transmission of a transmission signal upon the receipt of a deactivation signal; and a reset module for use by an official for allowing the transmission of the deactivation signal;

wherein a receiver of the transmission signal may locate the user and further deactivate the transmitter via the transmission of the deactivation signal and allow the device to be reused.

2. An emergency signal via incorporated transmitter device comprising:

a housing;

switch means adapted to transmit an activation signal at the discretion of a user; and a transmitter situated within the housing and in communication with the switch means, the transmitter adapted to transmit via free space a transmission signal for receipt by an emergency facility upon the receipt of the activation signal;

wherein a receiver of the transmission signal may locate the user and the the housing is portable and comprises a front face, a rear face, a top surface, a bottom surface, and a pair of side surfaces formed therebetween defining an interior space, the housing having a recess centrally formed in the front face thereof with the recess having a periphery including a pair of opposite open side edges in communication with the side surfaces of the housing, a transparent lid having a planar top surface and a pair of lips formed normal with respect to the top surface wherein one of the lips is pivotally coupled to one of the side edges of the recess via a hinge thus allowing the lid to be selectively situated about recess in a closed orientation and further reside in an open orientation for affording access to the recess, a locking mechanism situated on a side surface of the housing opposite the hinge and adapted to allow the selective securement of the lid in the closed orientation thereof, and a clip comprising a thin rectangular member pivotally coupled to the rear face of the housing for allowing the securement thereof to an article of clothing.

3. An emergency signal via incorporated transmitter device comprising:

a housing;

switch means adapted to transmit an activation signal at the discretion of a user; and a transmitter situated within the housing and in communication with the switch means, the transmitter adapted to transmit via free space a transmission signal for receipt by an emergency facility upon the receipt of the activation signal;

wherein a receiver of the transmission signal may locate the user and the housing is portable and comprises a front face, a rear face, a top surface, a bottom surface, and a pair of side surfaces formed therebetween defining an interior space, the housing having a recess centrally formed in the front face thereof and a transparent lid, the lid adapted to be selectively situated about recess in a closed orientation and further reside in an open orientation for affording access to the recess, the housing further having a clip for allowing the securement thereof to an article of clothing;

said switch means comprising a plurality of push button switches linearly aligned within the recess and comprising a first switch adapted to transmit a first activation signal upon the depression thereof, a second switch adapted to transmit a second activation signal upon the depression thereof, and a third switch adapted to transmit a third activation signal upon the depression thereof, wherein the present device comprises an associated red warning light adapted to illuminate for a predetermined amount of time upon the depression of a switch;

said transmitter adapted to transmit via free space a first transmission signal for intended receipt by a medical facility upon the receipt of the first activation signal, a second transmission signal for intended receipt by a law enforcement facility upon the receipt of the second activation signal, and a third transmission signal for intended receipt by a fire rescue facility upon the receipt of the third activation signal.

* * * * *